US008522516B2

(12) United States Patent
Ichikawa et al.

(10) Patent No.: US 8,522,516 B2
(45) Date of Patent: Sep. 3, 2013

(54) PACKAGING MACHINE

(75) Inventors: Makoto Ichikawa, Shiga (JP); Masashi Kondo, Shiga (JP)

(73) Assignee: Ishida Co., Ltd., Kyoto (JP)

( * ) Notice: Subject to any disclaimer, the term of this patent is extended or adjusted under 35 U.S.C. 154(b) by 168 days.

(21) Appl. No.: 12/466,703

(22) Filed: May 15, 2009

(65) Prior Publication Data

US 2009/0288376 A1 Nov. 26, 2009

(30) Foreign Application Priority Data

May 23, 2008 (JP) ..... 2008-135385

(51) Int. Cl.
*B65B 9/00* (2006.01)

(52) U.S. Cl.
USPC ..... 53/451; 53/545; 53/548; 53/551; 493/302; 493/308

(58) Field of Classification Search
USPC ..... 53/450, 451, 545, 548, 550, 551, 53/389.1, 389.2; 493/302, 308
See application file for complete search history.

(56) References Cited

U.S. PATENT DOCUMENTS 6,131,367 A * 10/2000 Fukuda et al. ..... 53/201
6,935,086 B2 * 8/2005 Brenkus et al. ..... 53/411
7,124,559 B2 10/2006 Taylor
7,152,387 B2 * 12/2006 Taylor ..... 53/511
7,415,809 B2 * 8/2008 Taylor ..... 53/167
7,523,597 B2 * 4/2009 Dominguez et al. ..... 53/451
2005/0066629 A1 * 3/2005 Taylor ..... 53/551
2005/0172582 A1 * 8/2005 Taylor ..... 53/511
2010/0037568 A1 * 2/2010 Hashimoto et al. ..... 53/551
2010/0043352 A1 * 2/2010 Hashimoto et al. ..... 53/375.9

FOREIGN PATENT DOCUMENTS

JP 2005-041576 A 2/2005

* cited by examiner

*Primary Examiner* — Alexandra Elve
*Assistant Examiner* — Eyamindae Jallow
(74) *Attorney, Agent, or Firm* — Global IP Counselors, LLP

(57) ABSTRACT

A packaging machine includes a packaging machine main body, a film transport unit, a former and a former insertion guide assembly. The film transport unit is coupled to the packaging main body to transport a film from a first end part of the packaging main body towards a second end part of the packaging main body opposite from the first end part. The former is disposed in the second end part of the packaging main body to form the film transported by the film transport unit into a cylindrical shape and to direct the film downwards. The former insertion guide assembly is configured and arranged to guide the former to a predetermined position in the second end part of the packaging machine main body while the former is rotated from a lateral side of the packaging machine main body when the former is mounted to the packaging machine main body.

14 Claims, 7 Drawing Sheets

PACKAGING MACHINE

CROSS-REFERENCE TO RELATED APPLICATIONS

This application claims priority to Japanese Patent Application No. 2008-135385, filed on May 23, 2008. The entire disclosure of Japanese Patent Application No. 2008-135385 is hereby incorporated herein by reference.

BACKGROUND OF THE INVENTION

1. Field of the Invention

The present invention relates to a packaging machine.

2. Background Information

Automatic packaging machines and various other packaging machines have conventionally been proposed in which a strip-shaped film is continuously molded into a cylindrical shape using a former, and the cylindrical film is first sealed vertically and then horizontally, whereby content-filled bags are automatically manufactured, as shown in Japanese Laid-Open Patent Application No. 2005-41576. With such an automatic packaging machine or another packaging machine, a bag size of about 100 mm to 250 mm, which is the bag size (bag width) specified for the machine, can generally be handled using a single machine, and the former and the film are replaced in correspondence with each size.

With a conventional packaging machine, an operator manually pulls the former and the support portion with his hand when the former is replaced, whereby the former and the support portion are moved forward or laterally in a straight line from the main body and are separated from the main body, whereupon the former is replaced.

In view of the above, it will be apparent to those skilled in the art from this disclosure that there exists a need for an improved former mounting arrangement. This invention addresses this need in the art as well as other needs, which will become apparent to those skilled in the art from this disclosure.

SUMMARY OF THE INVENTION

Conventionally, the former is made of steel or an alloy or the like having high strength and dimensional accuracy, and is a very heavy object ordinarily having a weight of about 30 kg. The film roll is wound with several hundred meters of strip-shaped film, and therefore ordinarily weighs about 40 kg. In the packaging industry of foodstuffs and the like in particular, there are cases in which about 50 multifarious types of bag sizes are used, and the work of replacing the former for changing sizes during the film replacement or the like requires considerable labor.

The former can be inserted into the packaging machine from the front of the packaging machine main body, providing so-called front access. When inserted in this direction, an operator must replace the former by twisting his body or using another uncomfortable posture because there is usually no space for the operator to stand due to the structural parts provided to a lower part of the packaging machine, such as a rising conveyor. Also, the packaging machine ordinarily has an erectly disposed tubular member or a tube that, together with the former, forms the film into a cylindrical shape and guides the cylindrical film downwards. However, when twin piping is used in which a plurality of tubes is arranged in a line, the workspace for replacing the former is further reduced.

In a case in which the former is rectilinearly moved and drawn out in the lateral direction of the packaging machine, as in the conventional packaging machine described in Japanese Laid-open Patent Application No. 2005-41576, the former must be drawn out to a position set at a sufficient distance from the main body so that the replacement work can be carried out. Therefore, considerable labor is required to replace the heavy former, and the movement distance of the former is increased. Space is also required for drawing out the former in the lateral direction of the main body.

An object of the present invention is to provide a packaging machine in which the former can be replaced easily.

A packaging machine according to a first aspect of the present invention includes a packaging machine main body, a film transport unit, a former and a former insertion guide assembly. The film transport unit is coupled to the packaging main body, and configured and arranged to transport a film as a packaging material from a first end part of the packaging main body towards a second end part of the packaging main body opposite from the first end part. The former is disposed in the second end part of the packaging main body, and configured and arranged to form the film transported by the film transport unit into a cylindrical shape and to direct the film downwards. The former insertion guide assembly is configured and arranged to guide the former to a predetermined position in the second end part of the packaging machine main body while the former is rotated from a lateral side of the packaging machine main body when the former is mounted to the packaging machine main body.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENT

Selected embodiment of the present invention will now be explained with reference to the drawings. It will be apparent to those skilled in the art from this disclosure that the following description of the embodiment of the present invention is provided for illustration only and not for the purpose of limiting the invention as defined by the appended claims and their equivalents.

Overall Configuration of Bag-Making Packaging Machine

Figure 1:
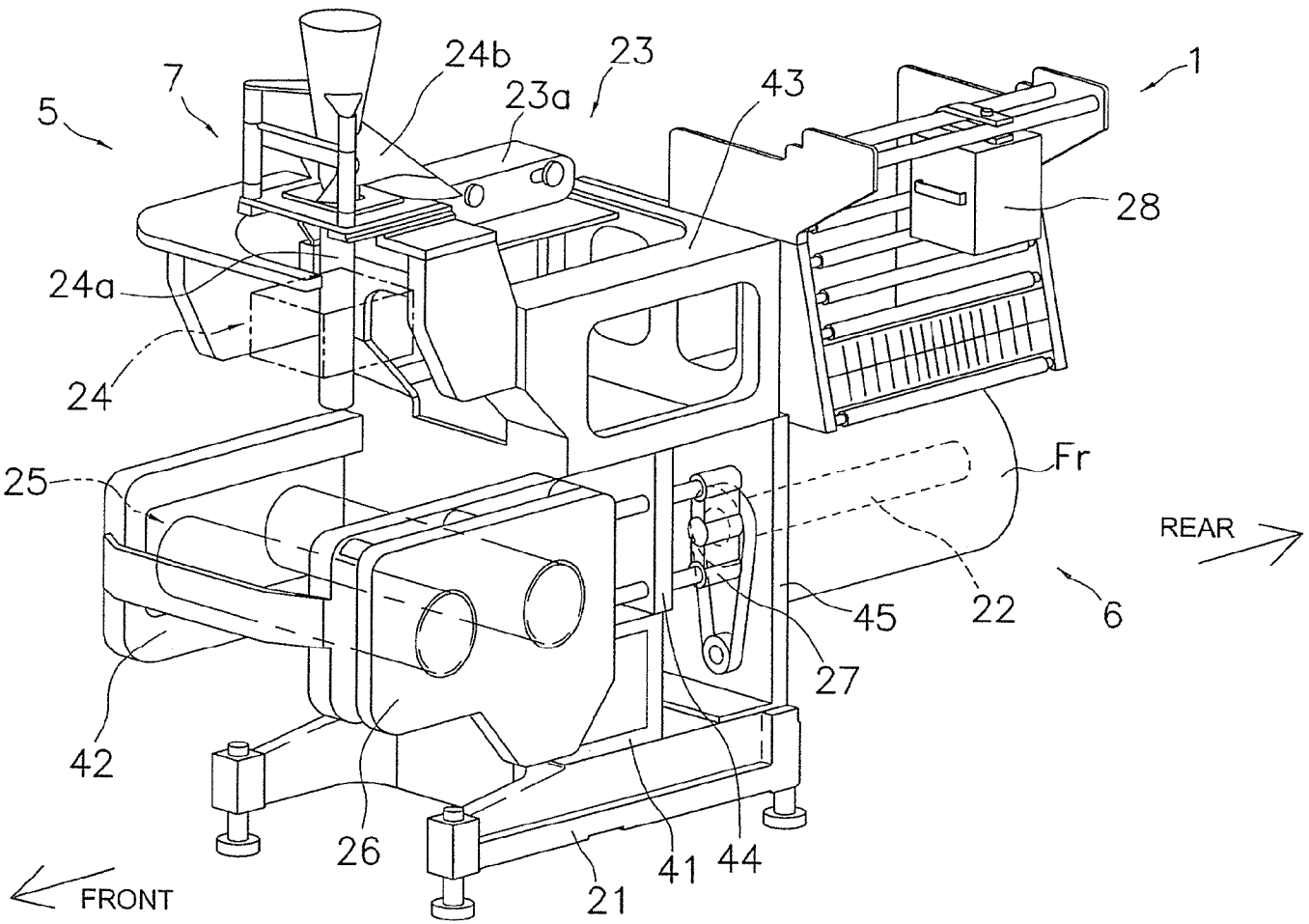
FIG. 1 is an overall front perspective view of a bag-making packaging machine according to an embodiment of the present invention.
Figure 2:
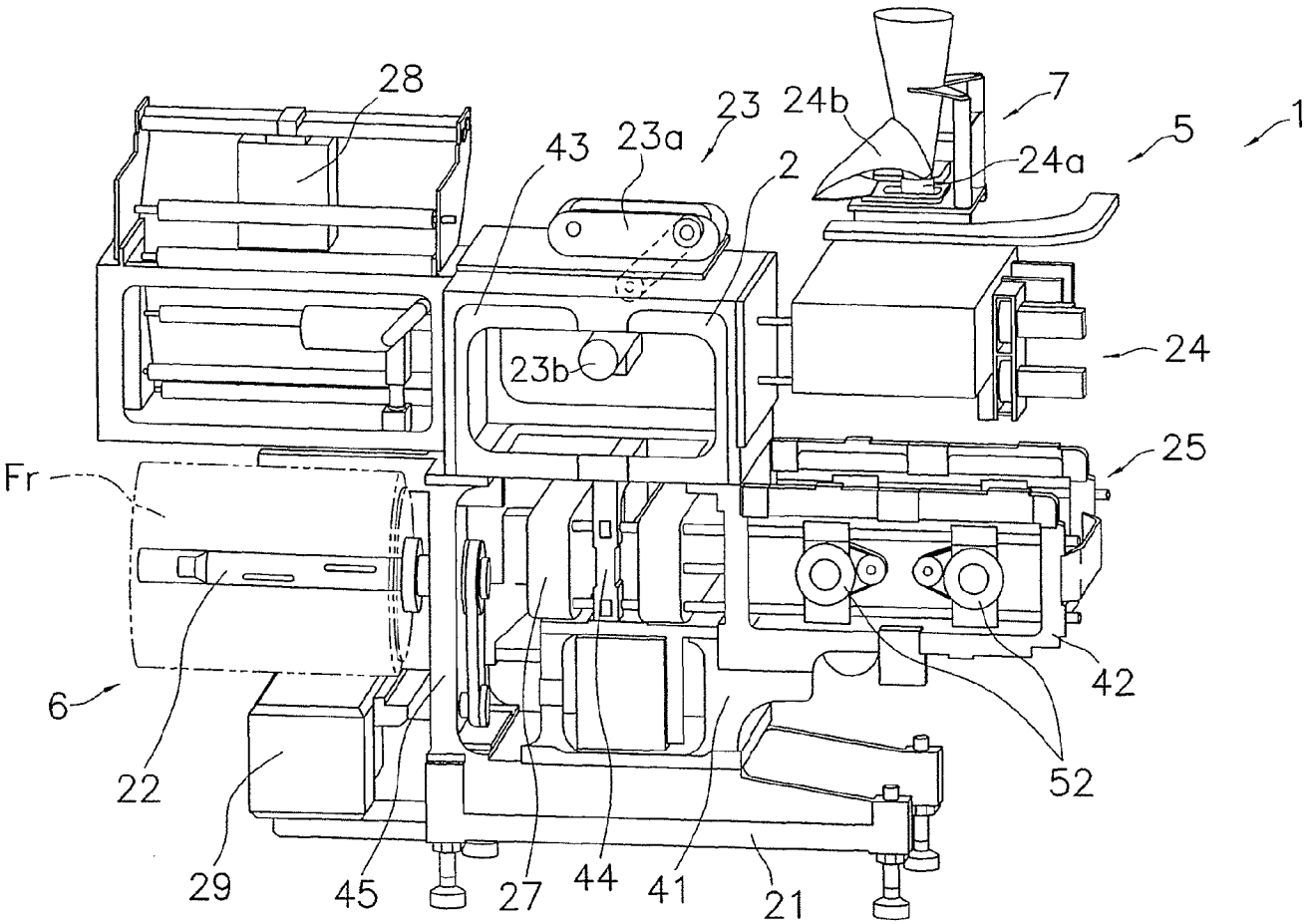
FIG. 2 is a side perspective view of the bag-making packaging machine of FIG. 1.

FIGS. 1 and 2 show a vertical bag-making packaging machine 1 according to the illustrated embodiment. The bag-making packaging machine 1 is one example of a packaging machine for covering the packaging object (such as potato chips or other foodstuffs) using a film F, and sealing the cylindrically formed film F vertically and laterally to manufacture a bag.

Predetermined amounts of the packaging object fall into a tube 24*a* (tubular member) from a weight scale (not shown) disposed above the bag-making packaging machine 1.

The bag-making packaging machine 1 mainly includes a packaging machine main body 2, a bag-making packaging portion 5 as the main body portion for bagging the packaging object, a film feed portion 6 for feeding to the bag-making packaging portion 5 the film F as the packaging material to be formed into a bag, and a former insertion guide assembly 7 for guiding a later-described former 24*b*, which forms the film F into a cylindrical shape, when the former 24*b* is being replaced.

Specifically, the bag-making packaging machine 1 is provided with a base foundation 21 and a plurality of functional parts such as an airshaft part 22, a pull-down part 23, a vertical seal part 24, a horizontal or lateral seal part 25, a gear box 26, a pressure unit 27, and a printing unit 28. The functional parts are formed into units (modules) to allow these parts to be combined, and the operation of the drive portion of each unit is controlled by a control device (not shown).

The packaging machine main body 2 is basically a combination of the base foundation 21 and first through fifth frames 41 to 45 that support the above-described functional parts as individual units.

The plurality of functional parts, i.e., the airshaft part 22, the pull-down part 23, the vertical seal part 24, the lateral seal part 25, the gear box 26, the pressure unit 27, and the printing unit 28 are each arranged as a module and supported by one of the first to fifth frames 41 to 45 on the base foundation 21, as shown in FIGS. 1 and 2.

Figure 4:
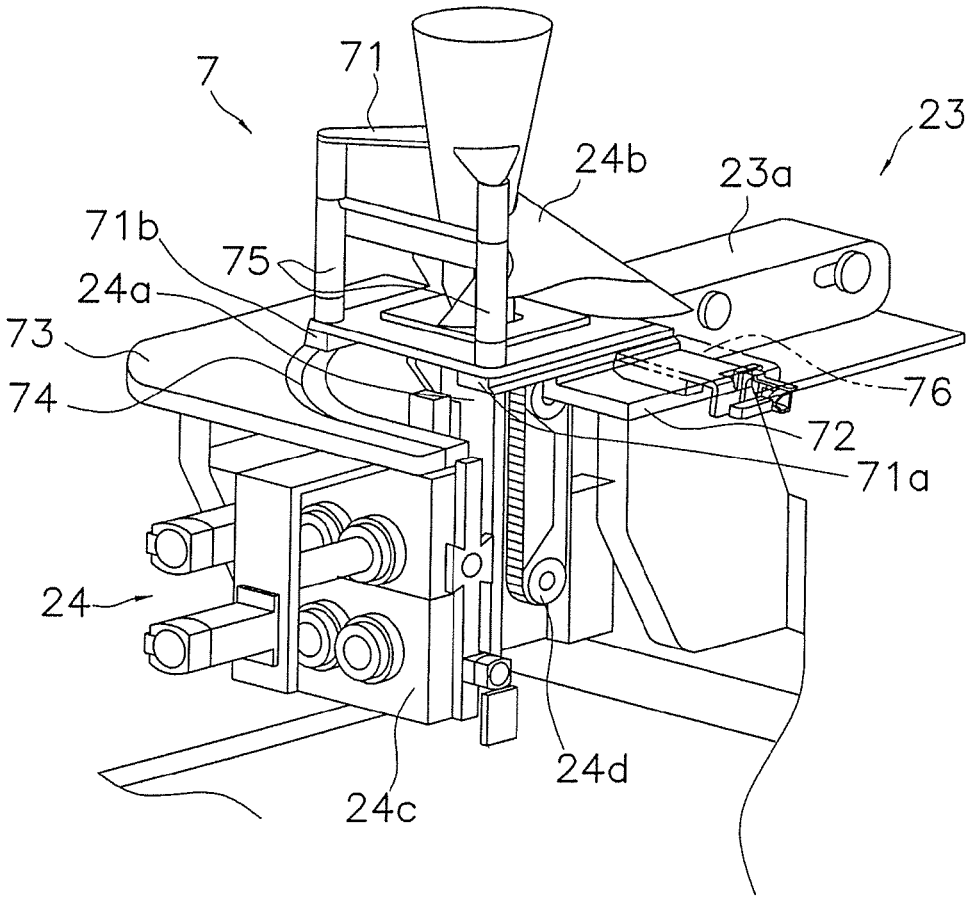
FIG. 4 is an enlarged perspective view of a former, a former insertion guide assembly and the vertical seal part of the bag-making packaging machine of FIG. 1.

The lateral seal part 25 and the gear box 26 are disposed in the second frame 42 located in the forward-most part (left front side of FIG. 1) of the packaging machine main body 2 as shown in FIGS. 1 and 4. The vertical seal part 24, the pull-down part 23, and the printing unit 28 are disposed in the third frame 43 located in the upper-most part of the packaging machine main body 2. The pressure unit 27 is supported by the second frame 42, the fourth frame 44, and the fifth frame 45. The airshaft part 22 is supported by the fifth frame 45. The drive motor 29 of the airshaft part 22 shown in FIG. 1 is also supported by the fifth frame 45.

Film Feed Portion

In the film feed portion 6, a film roll Fr on which the film F is wound is set on the airshaft part 22, and the film F is drawn out from the film roll Fr.

The film F drawn from the film roll Fr is fed by the operation of a drive motor 29 (see FIG. 2) for rotating the film roll Fr, and is transported by being pulled to the bag-making packaging portion 5 by the operation of the pull-down part 23. The movement of the drive motor 29 and the pull-down part 23 is controlled by the control device.

Specifically, the film feed portion 6 has the airshaft part 22 for vacuum chucking and rotatably driving the film roll Fr, and the pull-down part 23 for drawing the film F wound on the film roll Fr toward the vertical seal part 24. The pull-down part 23 corresponds to the film transport unit. In other words, the pull-down part 23 is provided to the packaging machine main body 2 and transports the film F from the rear side (an example of the first end part) towards the front side (an example of the second end part) of the packaging machine main body 2.

The pull-down part 23 has a chucking belt mechanism 23*a*, a vacuum pump (not shown) for generating the suction force of the chucking belt mechanism 23*a*, and a drive unit 23*b* for rotating the chucking belt. The drive unit 23*b* of the vacuum pump and the chucking belt are disposed in the space inside the first to fifth frames 41 to 45.

The printing unit 28 prints characters or symbols that show the manufacturing date and other information on the surface of the film F drawn out from the film roll Fr.

The film feed portion 6 as explained above is a conventional structure that is well known in the art. Since the film feed portion 6 is well known in the art, the structure will not be discussed or illustrated in detail herein. Rather, it will be apparent to those skilled in the art from this disclosure that the film feed portion 6 can be any type of structure that can be used to carry out the present invention.

Bag-Making Packaging Portion

Figure 3:
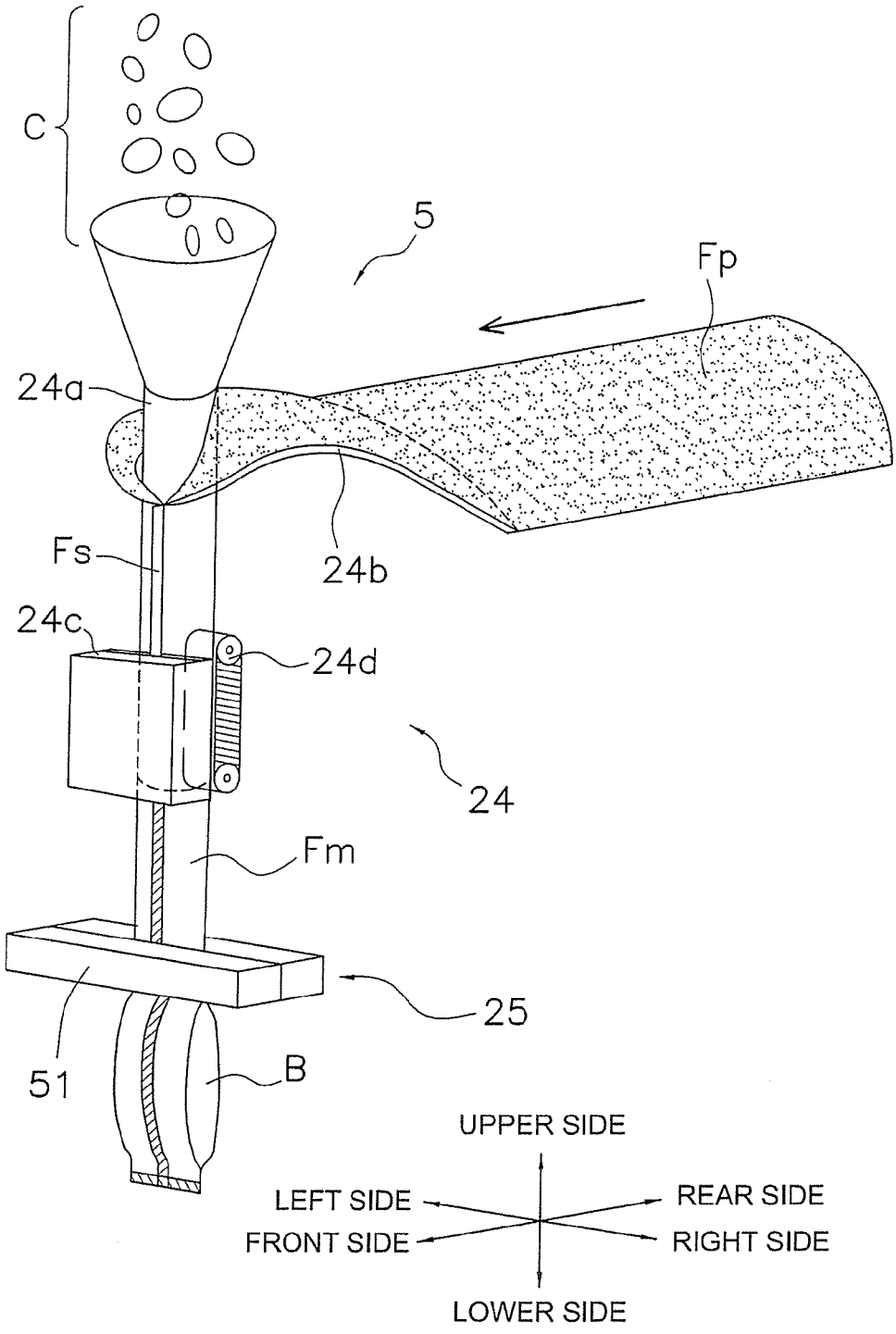
FIG. 3 is a schematic view of a vertical seal part and a lateral seal part of the bag-making packaging machine of FIG. 1.

The bag-making packaging portion 5 has the vertical seal part 24 for forming the film F into a cylindrical shape and vertically sealing the seam in the vertical direction (the transport direction of the film F), as shown in FIGS. 1 to 3. The bag-making packaging portion 5 also has the lateral seal part 25 for laterally sealing the cylindrically-formed film Fm in the lateral direction (the width direction of the film F) by using a pair of seal jaws 51. The gear box 26 and the pressure unit 27 drive the lateral seal part 25 in order to open and close the seal jaws 51 and to perform other operations.

The bag-making packaging portion 5 as explained above is a conventional structure that is well known in the art except for inclusion of the former insertion guide assembly 7 described in more detail below. Since the bag-making packaging portion 5 is well known in the art, the structure will not be discussed or illustrated in detail herein. Rather, it will be apparent to those skilled in the art from this disclosure that the bag-making packaging portion 5 can be any type of structure that can be used to carry out the present invention.

Vertical Seal Part 24

The vertical seal part 24 has the tube 24*a*, the former 24*b*, a vertical seal heater 24*c*, and a pull-down roller 24*d*. The tube 24*a* is a cylindrically shaped member having open upper and lower ends. A packaging object C weighed using a weight scale (not shown) disposed in the tube 24*a* is loaded into the opening at the upper end of the tube 24*a*.

The former 24*b* is a member for forming the film F into a cylindrical shape with directing downwards and is disposed so as to surround the tube 24*a*. The shape of the former 24*b* is designed to form the sheet-shaped film F as drawn from the film roll Fr into a cylindrical shape when the film F passes between the former 24*b* and the tube 24*a*. The tube 24*a* and the former 24*b* can be replaced in accordance with the size of the bag to be manufactured.

The vertical seal heater 24*c* sandwiches the overlapping portion Fs of the cylindrical film Fm wound on the tube 24*a* and makes a vertical seal from the two sides of the overlapping portion in a state in which the overlapping portion Fs has protruded from the surface of the tube 24*a*, as shown in FIGS. 3 and 4.

In the present embodiment, the vertical seal heater 24*c* sandwiches the overlapping portion Fs from the both sides thereof of the cylindrical film Fm and makes a vertical seal, but other methods may be used to make the vertical seal. For example, the vertical seal heater 24*c* may be heated by being pressed against the tube 24*a* with a constant pressure to form a vertically seal on the overlapping portion of the cylindrical film Fm.

Lateral Seal Part 25

The lateral seal part 25 is disposed below the vertical seal part 24. The lateral seal part 25 is a mechanism that includes a pair of seal jaws 51 that accommodate a heater.

Although not shown in FIG. 3, the lateral seal part 25 has a jaw-rotating motor for rotating the seal jaws 51 so that each of the pair of seal jaws 51 forms a mutually symmetric D-shaped trajectory.

A cutter (not shown) is accommodated inside one of the seal jaws 51. The cutter cuts and separates the bag B and the trailing cylindrical film Fm in a center position in the height direction of the lateral seal portion made by the seal jaws 51.

Former Insertion Guide Assembly

The former insertion guide assembly 7 is configured and arranged to guide the former 24*b* to a predetermined position on the front side of the packaging machine main body 2 while rotating the former 24*b* on a horizontal plane from the lateral side of the packaging machine main body 2 when the former 24*b* is mounted to the packaging machine main body 2.

Figure 5:
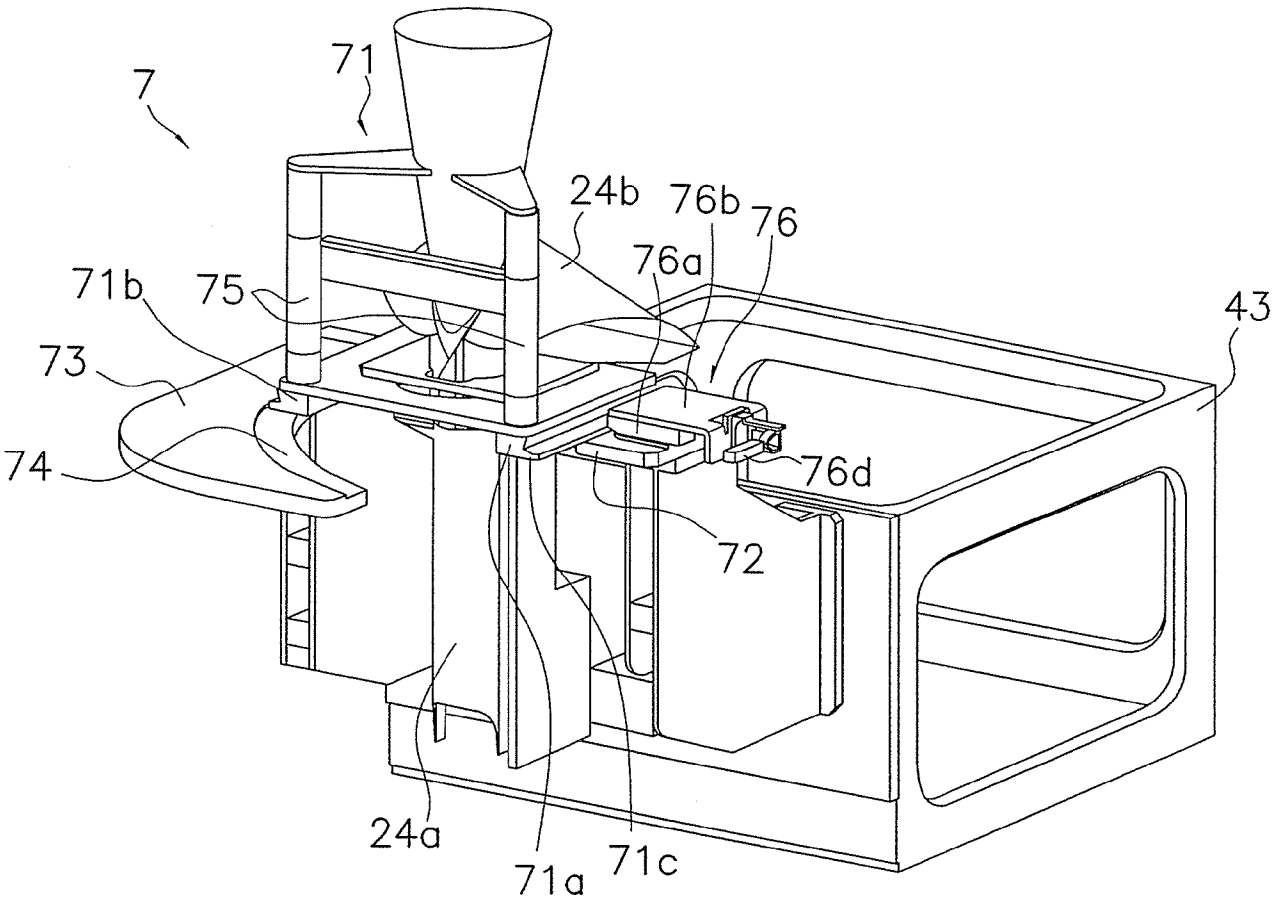
FIG. 5 is a perspective view of the former and the former insertion guide assembly coupled to a frame of the bag-making packaging machine showing a state in which a guide main body of the former insertion guide assembly is placed in a former-mounting position.
Figure 6:
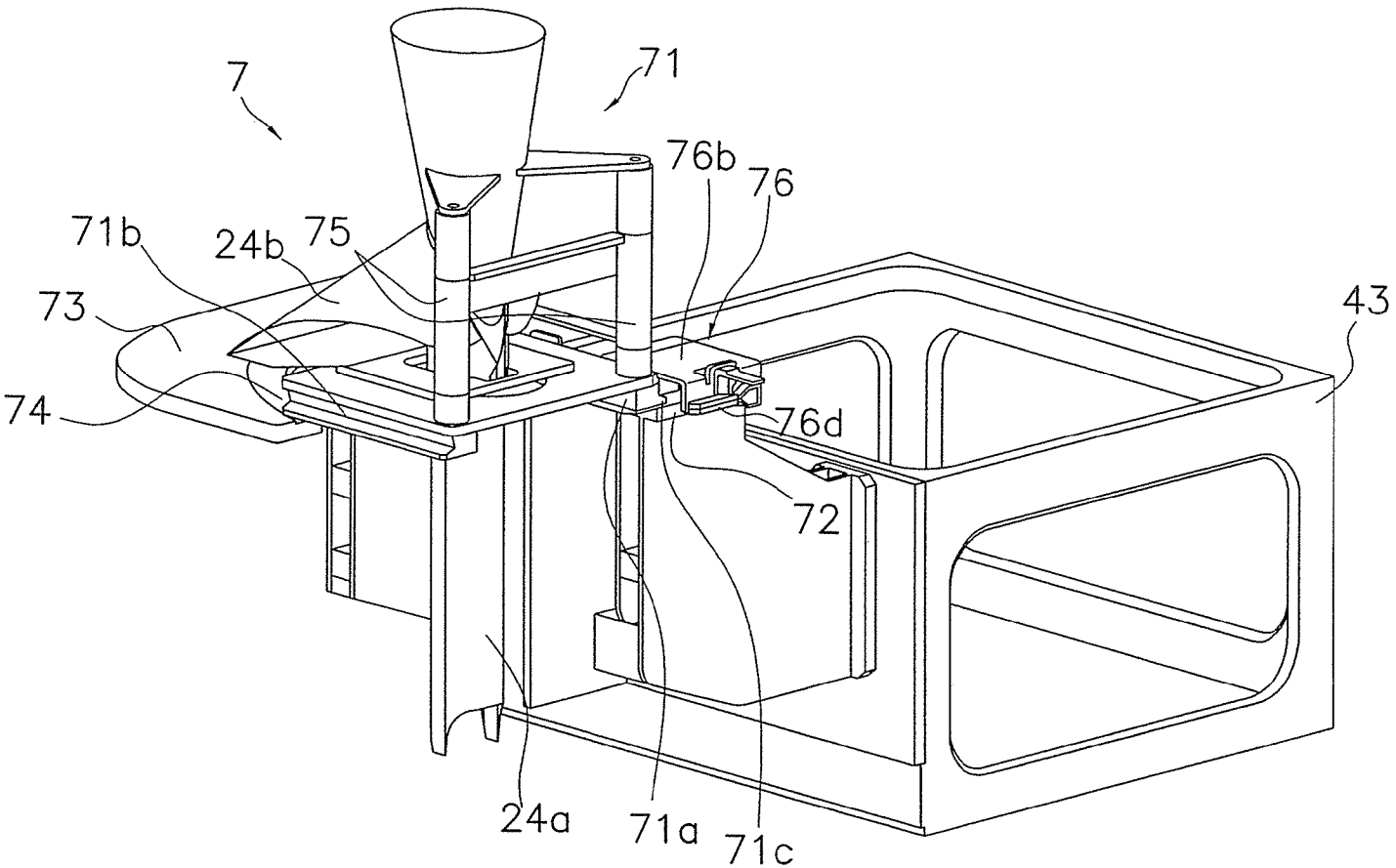
FIG. 6 a perspective view of the former, the former insertion guide assembly, and the frame of the bag-making packaging machine showing a state in which the guide main body of the former insertion guide assembly is placed in a former-mounting position.

Specifically, the former insertion guide assembly 7 has a guide main body 71, a first support unit 72, and a second support unit 73, as shown in FIGS. 4 to 6. The guide main body 71 supports the former 24*b*. The first support unit 72 rotatably and slidably supports a leg part 71*a*, which is one end (first end section) of the guide main body 71, on the upper surface of the first support unit 72. The second support unit 73 has a guide rail 74. As shown in FIGS. 4, 5 and 6, the guide rail 74 has an upwardly facing generally arcuate shaped surface that defines an arcuate pathway for guiding a leg part 71*b*, which is another end (second end section) of the guide main body 71. The guide rail 74 is configured and arranged to guide the leg part 71*b* along the arcuate shaped surface (the arcuate pathway while turning the guide main body 71 by approximately 90° between a predetermined former mounting position (see FIG. 5) in the packaging machine main body 2 and a predetermined former replacement position (see FIG. 6). The leg part 71*a* slides on the upper surface of the first support unit 72 while the leg part 71*b* is guided by the guide rail 74 and the main body 71 turns approximately 90°.

In this manner, the former 24*b* can be readily mounted because the bag-making packaging machine 1 is provided with the former insertion guide assembly 7 for inserting the former 24*b* while rotating the former 24*b* from the lateral side of the packaging machine main body 2.

Also, the configuration of the former insertion guide assembly 7 as described above makes it possible for the guide main body 71 that supports the former 24*b* to turn approximately 90° on the horizontal plane along the guide rail 74, and for the guide main body 71 to be readily turned approximately 90° with little effort.

The former 24*b* may be secured to the guide main body 71 using various methods as long as the methods make it possible to readily and reliably secure the former 24*b* to the guide main body 71. For example, the former 24*b* may be secured to the guide main body 71 using screws or bolts, or the like.

The guide main body 71 has a pair of grip portions 75 that is arranged to be physically gripped by hands of an operator as shown in FIGS. 4-6. The grip portions 75 are disposed in positions near the first support unit 72 and the second support unit 73, respectively. Therefore, the guide main body 71 can be readily turned approximately 90° with little effort while the operator holds the grip portions 75.

The guide main body 71 further supports the tube 24*a* as well as the former 24*b*. Therefore, the tube 24*a* can rotate together with the former 24*b* to make it even easier to replace the former 24*b*.

The former insertion guide assembly 7 has a lock mechanism 76 that selectively restricts and releases the rotation of the guide main body 71 with respect to the packaging machine main body 2.

Figure 7:
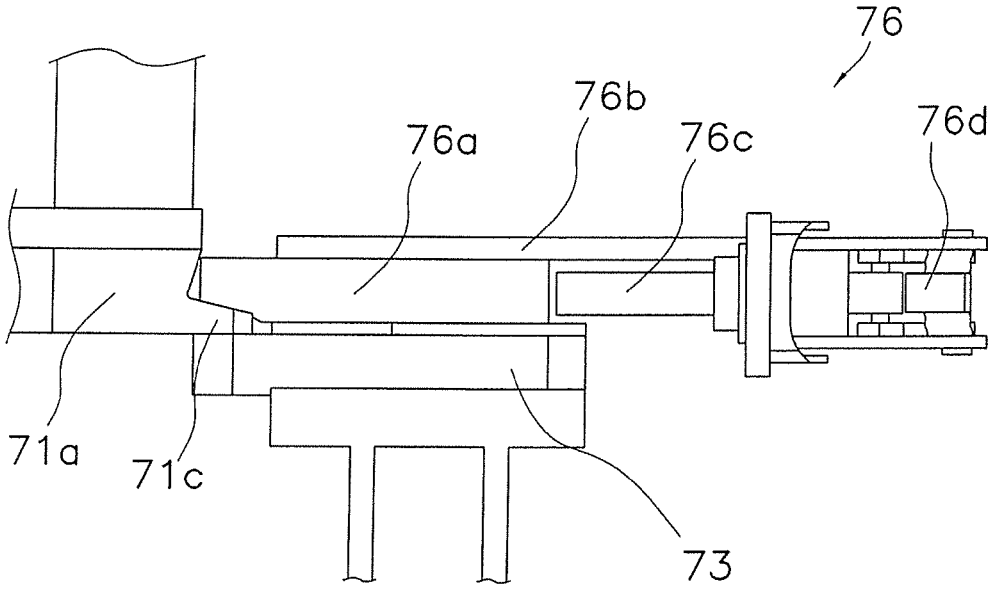
FIG. 7 is an enlarged partial front view of the former insertion guide assembly showing a lock mechanism.

More specifically, as shown in FIGS. 5 to 7, the lock mechanism 76 has a block 76*a* that fits onto a flange part 71*c* formed on a side surface of the leg part 71*a* of the guide main body 71, a support portion 76*b* for reciprocatingly supporting the block 76*a*, a cylinder 76*c* for pressing the block 76*a* toward the flange part 71*c* of the guide main body 71, and a handle 76*d* for causing the cylinder 76*c* to move in a reciprocating manner.

Therefore, when an operator operates the handle 76*d* to press the block 76*a* against the flange part 71*c* of the guide main body 71 via the cylinder 76*c*, the guide main body 71 can be reliably locked with a simple operation.

The guide main body 71 can thereby be locked by the lock mechanism 76 so that the guide main body 71 does not move in a state in which the guide main body 71 is set in a predetermined former mounting position (see FIG. 5) in the packaging machine main body 2. Also, since the guide main body 71 is allowed to move by releasing the lock mechanism 76 during former replacement, the guide main body 71 can be rotatably moved and the former 24*b* can be readily replaced.

The lock mechanism 76 is configured so as to be easily operated and capable of preventing erroneous operation, such as tilting the handle 76*d* in one direction to achieve a locked state, and tilting the handle 76*d* in another direction to achieve a released state.

Features of the Embodiment (1) With the bag-making packaging machine 1 of the embodiment, the former insertion guide assembly 7 guides the former 24*b* to a predetermined position on the front side of the packaging machine main body 2 while rotating the former 24*b* from the lateral direction of the packaging machine main body 2.

The former 24*b* can thus be mounted easily in a simple manner because the bag-making packaging machine 1 is provided with a former insertion guide assembly 7 that inserts the former 24*b* while rotating the former 24*b* from the lateral direction of the packaging machine main body 2. Also, the former 24*b* can be automatically loaded or mounted if an automatic mounting mechanism is provided to the side of the bag-making packaging machine 1 in order to mount a plurality of formers 24*b* that correspond to the bag sizes.

(2) The former 24*b* can be slidably inserted from the lateral direction by using the former insertion guide assembly 7, as shown in FIGS. 5 to 6. For example, the former insertion guide assembly 7 is first mounted in the lateral direction and is then rotated while being pressed inward, whereby the former 24*b* is mounted. Therefore, the mounting can be carried out with little effort in a simple manner even by a person of average physical abilities, i.e. a woman or the like.

A former rack can be disposed to the side of the bag-making packaging machine 1 since mounting from the lateral direction is possible, and automatic mounting of the former 24*b*, which has heretofore been impossible, can be carried out in the manner of an automatic tool switching mechanism of a machining center.

Therefore, the configuration can be made more user friendly in that the labor of replacing the former 24*b* can be considerably reduced by using the former insertion guide assembly 7 in the manner described above.

(3) In particular, with a lateral slide scheme in which the former and portions that support the former are moved in a rectilinearly reciprocating fashion in the lateral direction of the packaging machine main body as in Japanese Laid-Open Patent Application No. 2005-41576, the former and portions that support the former must first be moved to a position sufficiently separated from the packaging machine main body so as to avoid interfering with the packaging machine main body when the former is replaced. Therefore, the movement distance of the former and portions that support the former must be increased. On the other hand, in the case of the lateral rotation scheme in which the former 24*b* and the former insertion guide assembly 7 are first rotated in the lateral direction inside the packaging machine main body 2 in the manner of the bag-making packaging machine 1 of the present embodiment, the work of mounting the former 24*b* can be carried out over a short movement distance.

(4) With a common automatic packaging machine, the work of replacing the former 24*b* from the front direction of the packaging machine main body 2 is difficult and involves heavy labor because a mechanism such as a vertical seal heater 24*c*, or a rising conveyor is disposed in the front area of the former 24*b* and the tube 24*a*. However, with the bag-making packaging machine 1 of the present embodiment, the former 24*b* and the former insertion guide assembly 7 are merely first rotated in the lateral direction inside the packaging machine main body 2. Therefore, the work of mounting the former 24*b* from the lateral direction of the packaging machine main body 2 can be carried out in a simple manner without any interference from obstacles (a mechanism such as the vertical seal heater 24*c*, or a rising conveyor or the like) in front of the packaging machine main body 2.

(5) With the bag-making packaging machine 1 of the embodiment, the former insertion guide assembly 7 has the guide main body 71, the first support unit 72, and the second support unit 73 according to one specific configuration. The guide main body 71 supports the former 24*b*. The first support unit 72 rotatably supports one end part of the guide main body 71. The second support unit 73 has a guide rail 74. The guide rail 74 has an arcuate pathway and guides the other end part of the guide main body 71 along the arcuate pathway while turning the other end part by approximately 90° between a predetermined former mounting position (see FIG. 5) in the packaging machine main body 2 and a predetermined former replacement position (see FIG. 6).

The former insertion guide assembly 7 is configured to turn the guide main body 71, which supports the former 24*b*, by approximately 90° along the guide rail 74, whereby the guide main body 71, which supports the former 24*b*, can be readily turned approximately 90° with little effort while being supported by the first support unit 72 and the second support unit 73.

(6) In the bag-making packaging machine 1 of the embodiment, the guide main body 71 has a pair of grip portions 75 disposed in positions near the first support unit 72 and the second support unit 73, respectively. The grip portions 75 are configured and arranged to be gripped by hands of an operator. The guide main body 71 can thereby be readily turned approximately 90° with little effort using the pair of grip portions 75.

(7) With the bag-making packaging machine 1 of the embodiment, the guide main body 71 supports the tube 24*a* in addition to the former 24*b*. The tube 24*a* can also be rotated approximately 90° together with the former 24*b*, and replacement of the former 24*b* is therefore further facilitated. The replacement work can be readily carried out even when the tube 24*a* and the former 24*b* are both replaced.

(8) With the bag-making packaging machine 1 of the embodiment, the former insertion guide assembly 7 has a lock mechanism 76 for selectively restricting the rotation of the guide main body 71 with respect to the first and second support units 72 and 73 and releasing the restriction. Therefore, the guide main body 71 can thereby be locked by the lock mechanism 76 so as to be prevented from moving in a state in which the guide main body 71 is set in the predetermined former mounting position (see FIG. 5) in the packaging machine main body 2. Also, the guide main body 71 can be rotatably moved and the former 24*b* can be readily replaced by releasing the lock mechanism 76 when the former 24*b* is replaced.

The illustrated embodiment can be applied to a packaging machine in which the former is required to be replaced.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. The terms of degree such as "substantially", "about" and "approximately" as used herein mean a reasonable amount of deviation of the modified term such that the end result is not significantly changed.

While only selected embodiment has been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing description of the embodiment according to the present invention is provided for illustration only, and not for the purpose of limiting the invention as defined by the appended claims and their equivalents.

What is claimed is:

1. A packaging machine comprising:

a packaging machine main body;

a film transport unit coupled to the packaging machine main body, and configured and arranged to transport a film as a packaging material from a rear of the packaging machine main body towards a front of the packaging machine main body;

a former disposed in the front of the packaging machine main body, and configured and arranged to form the film transported by the film transport unit into a cylindrical shape and to direct the film downwards; and a former insertion guide assembly configured and arranged to guide the former to a predetermined former mounting position in the front of the packaging machine main body from a predetermined former replacement position at a lateral side of the front of the packaging machine main body, the former insertion guide assembly including a main body, a first support unit and a second support unit, the main body directly supporting the former, the first support unit being attached to the front of the packaging machine main body and rotatably supporting a first leg part of the main body, the first support unit supporting the first leg part during rotational movement of the former between the predetermined former replacement position and the predetermined former mounting position, the second support unit being attached to the front of the packaging machine main body and including a guide rail having a horizontal surface that extends arcuately defining a helically shaped pathway, with a second leg part of the main body being slidably supported on the horizontal surface of the guide rail during rotational movement relative to the former such that a portion of the second leg part is moved on the horizontal surface along the helically shaped pathway between the predetermined former mounting position and the predetermined former replacement position.

2. The packaging machine according to claim 1, wherein the main body includes a pair of grip portions disposed adjacent to the first support unit and the second support unit, respectively, and configured and arranged to be gripped by hands of an operator.

3. The packaging machine according to claim 2, further comprising a tubular member configured and arranged to cylindrically mold the film together with the former, the main body further supporting the tubular member.

4. The packaging machine according to claim 3, wherein the former insertion guide assembly further has a lock mechanism configured and arranged to selectively restrict a rotation of the main body with respect to the first and second support units.

5. The packaging machine according to claim 1, further comprising a tubular member configured and arranged to cylindrically mold the film together with the former, the main body further supporting the tubular member.

6. The packaging machine according to claim 5, wherein the former insertion guide assembly further has a lock mechanism configured and arranged to selectively restrict a rotation of the main body with respect to the first and second support units.

7. The packaging machine according to claim 5, wherein the tubular member is disposed between the first and second support units.

8. The packaging machine according to claim 1, wherein the former insertion guide assembly further has a lock mechanism configured and arranged to selectively restrict a rotation of the main body with respect to the first and second support units.

9. The packaging machine according to claim 8, wherein the lock mechanism disposed on the first support unit.

10. The packaging machine according to claim 1, wherein the main body is rotatable by an angle of approximately 90° along the horizontal surface that defines the helically shaped pathway of the guide rail during rotational movement relative to the first support unit between the predetermined former mounting position and the predetermined former replacement position.

11. The packaging machine according to claim 1, wherein the second support unit includes a flat surface portion and the horizontal surface, the horizontal surface being recessed with respect to the flat surface.

12. The packaging machine according to claim 1, wherein the first support unit and the second support unit are spaced apart from one another.

13. The packaging machine according to claim 12, wherein the main body includes a pair of grip portions disposed adjacent to the first support unit and the second support unit, respectively, and configured and arranged to be gripped by hands of an operator.

14. The packaging machine according to claim 13, wherein the tubular member is disposed between the first and second support units.

* * * * *